United States Patent [19]

Richter, nee Redomske

[11] 4,073,405

[45] Feb. 14, 1978

[54] GIFT-DISPENSING DEVICE

[76] Inventor: Gabriele Richter, nee Redomske, 8 Wiesenstrasse, D-5481 Remagen-Unkelbach, Germany

[21] Appl. No.: 733,754

[22] Filed: Oct. 19, 1976

[30] Foreign Application Priority Data

Aug. 10, 1976 Germany ..... 7625057[U]

[51] Int. Cl.[2] ..... A63F 9/00

[52] U.S. Cl. ..... 221/89; 221/240

[58] Field of Search ..... 221/89, 24, 240; 273/138 R; 211/57.1, 59.1

[56] References Cited

U.S. PATENT DOCUMENTS 3,173,530 3/1965 Lord ..... 221/240 X

*Primary Examiner*—Stanley H. Tollberg
*Attorney, Agent, or Firm*—Michael J. Striker

[57] ABSTRACT

A gift dispensing device is provided for dispensing gifts to children. The device may be represented as a Santa Claus and exhibited upon a fabric support. The device includes a mounting strip with a plurality of apertures located at the top of the support. Suspension pegs are inserted at one end into at least some of the apertures while the other end of each peg is attached to a grip identified with a number or symbol. Each suspension peg holds a ring which is connected to one end of a line. Hands with borings are provided for the Santa Claus. The lines pass through the borings. The other end of each line is attached to a small gift container.

13 Claims, 8 Drawing Figures

GIFT-DISPENSING DEVICE

BACKGROUND OF THE INVENTION

This invention is related to a figure of a gift-bearing Santa Claus which holds gifts within a plurality of small containers, each of which can be raised or lowered by engaging or disengaging the respective suspension peg with an aperture within the mounting board.

It is customary, especially in some Northern European countries, to distribute pre-Christmas gifts to children. This involves so-called Advent Calendars having a base plate which is formed with recesses, one for each day of the advant season. These recesses are closed with flaps which bear the date of the respective day and which the children open in order to take a present, usually a sweet. Customarily, each child will take turns. This arrangement is often dissatisfactory to the child whose turn is last; however, space limitations on the calendar precludes the use of more than one gift per recess, thus making it impossible to gift two or more children on one and the same day.

SUMMARY OF THE INVENTION

It is the primary object of the present invention to overcome the above-mentioned disadvantage.

It is another object of the present invention to provide a gift-dispensing device which can simultaneously distribute gifts to two or more children.

It is still another object of the present invention to provide a sturdy figure of the traditional model of a gift-bearing Santa Claus for young children.

It is still a further object of the present invention to provide a gift-dispensing device with gifts inside containers which are normally in a raised position (closer to Santa's hands) in order to hold the gifts, and which can be moved to a lowered position in order to permit distribution of the gifts.

The present invention is directed to a gift-bearing Santa Claus. The Santa Claus is exhibited upon a fabric support and includes a mounting strip at the top of the base. The mounting strip has a plurality of apertures. Suspension pegs are inserted at one end into at least some of the apertures while the other end of each peg is attached to a grip identified with a number or a symbol. Each suspension peg holds a ring which is connected to one end of a thin line. The ring may be plastic or metal. Hands with borings are provided for the Santa Claus. A plurality of the lines pass through each of the outstretched hands. The other end of each line is attached to a small container which can contain gifts, such as candy. The child chooses his gift by choosing a number or symbol which corresponds to a number or symbol upon the grip. The child then pulls out the grip, disengaging the attached suspension peg from its aperture. The ring which was held by the peg is freed, and the container attached to the line of the respective ring falls to a lower position at which it is held because of the detention of the ring on the back side of the hand. Alternatively, many children can simultaneously decide upon a number or symbol, disengage the respective peg and receive their presents.

Of course, the figure need not be of Santa Claus but could be of another character, e.g., the Christ Child in Germany or Saint Nikolas in Holland.

The novel features which are considered as characteristic are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
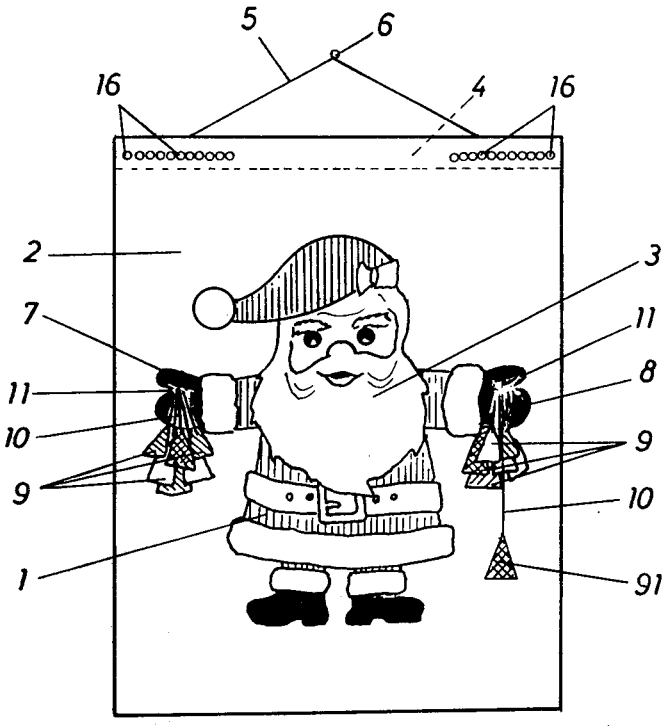
FIG. 1 is a frontal view of the present invention.

Referring to FIG. 1, the gift-dispensing device 1 and the support 2 are comprised of fabric. The figure here has the shape of Santa Claus whose beard 3 is made from artificial fur, cotton or the like. The support 2 is preferably made from strong synthetic plastic foil (e.g., polyethylene) 0.5 – 1 mm thick, although other materials and/or thicknesses are suitable. The upper side of the support 2 is bordered by a mounting strip 4, preferably made from wood. A supporting string 5 is fastened to each end the mounting strip 4 in order that the gift-bearing Santa Claus can be hung from a wall hook 6.

The gift-bearing Santa Claus will preferably have the appearance of the classical Santa Claus, though he might also be represented as a Christmas angel, a saint, or even as an Easter Bunny. The Santa Claus holds in each of his outstretched hands 7, 8 a plurality of containers or bags 9. These bags 9 are made from fabric, paper, or synthetic plastic foil. What can be done is to mark each bag directly with a day of the Christmas season to a bag so that the bag may be opened on the corresponding day of the season. However, the bags can be indirectly identified with the respective day, as will be explained later. These bags 9 are preferably colored and fastened to a thin line 10, which runs through a hole 11 in one of the hands 7, 8. It is preferable to provide the support with a circular reinforcement 13 on the back side of each hole 11 in order to protect against wear. The diameter of the reinforcement 13 is smaller than the diameter of each of the rings 12.

After passing up through the hole of one of the hands, each line 10 terminates by being attached to a ring 12, preferably made from metal or plastic. Each ring 12 is suspended from a suspension peg 14 and is positioned behind the support 2. Each suspension peg has been inserted into an aperture 15 of the mounting strip 4 and can be completely or partially disengaged therefrom.

Figure 2:
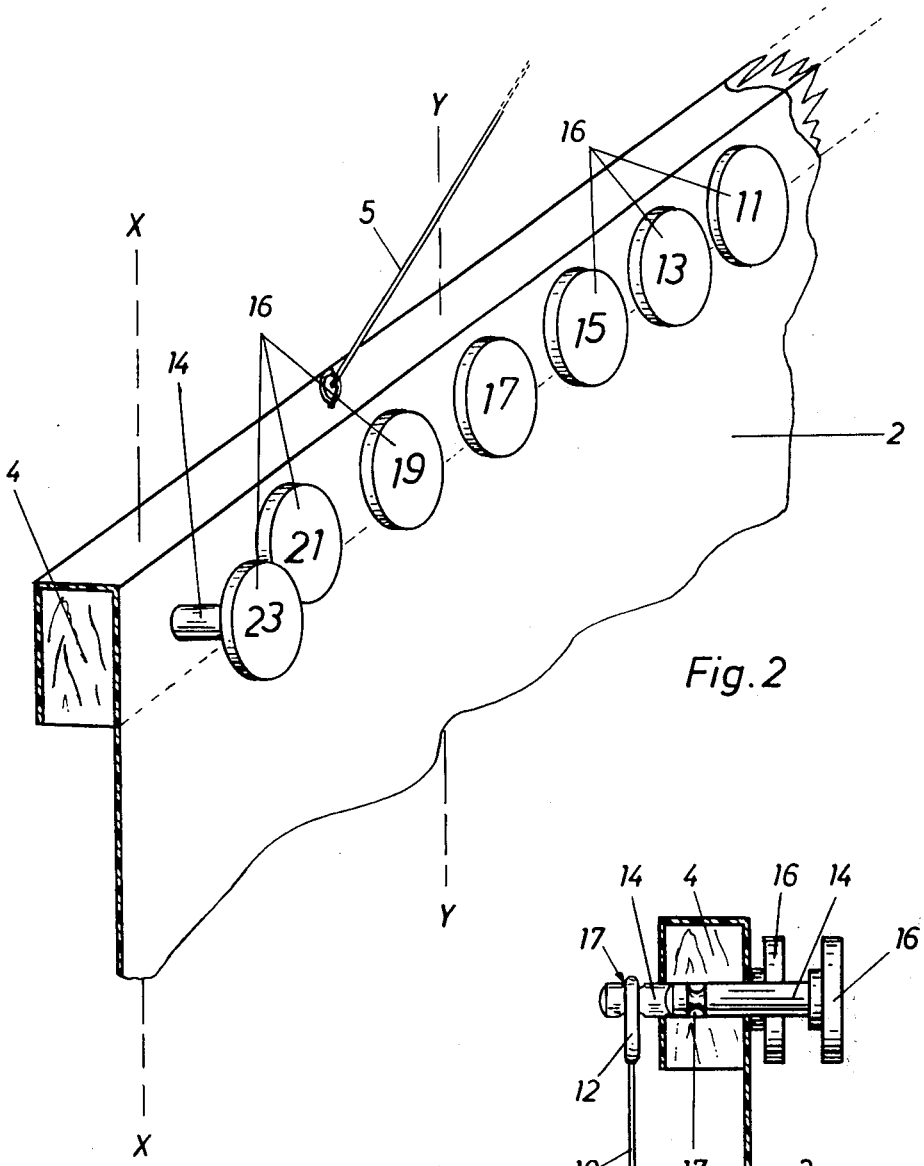
FIG. 2 is a partial rear top view of the present invention.
Figure 3:
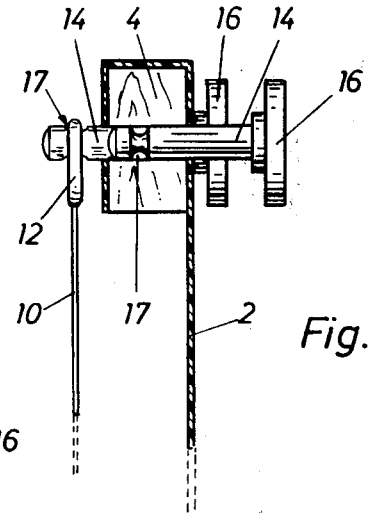
FIG. 3 is a partial cutaway side section of the present invention showing the preferred construction of the suspension peg.
Figure 4:
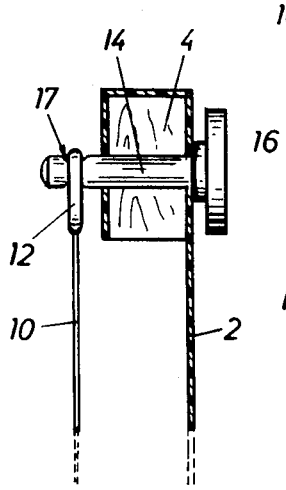
FIG. 4 is a partial cutaway side section view of the invention showing an alternate construction of the suspension peg.
Figure 5:
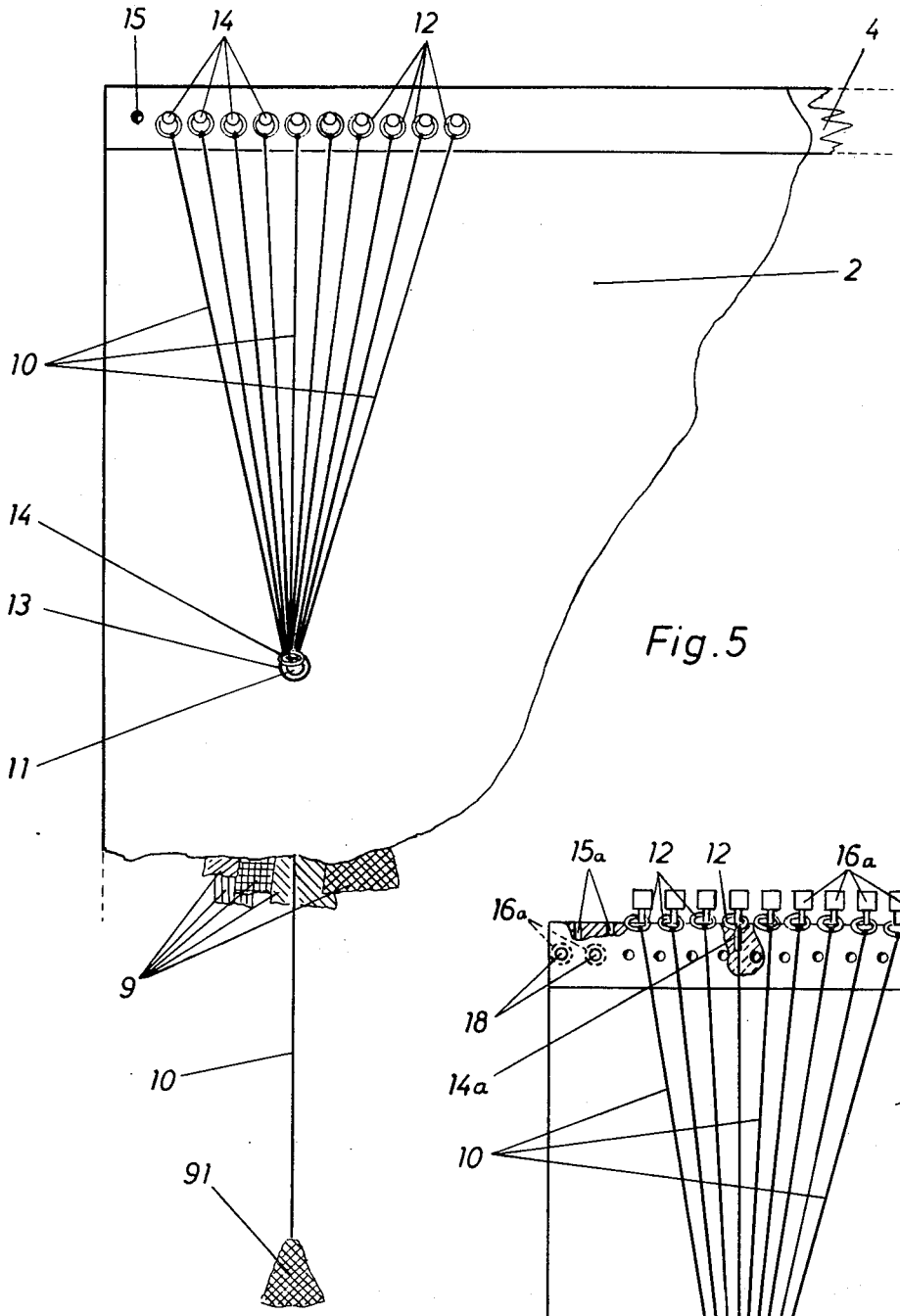
FIG. 5 is a partial rear view showing an embodiment of the present invention having horizontally arranged suspension pegs.

In the embodiments shown in FIGS. 2 – 5, each suspension peg 14 is essentially horizontally disposed and is equipped with a grip 16 fastened to the free end of the peg. Each suspension peg 14 is provided with a circular notch 17 which is positioned upon the peg in such a manner that the part of the peg with the notch will protrude from the other side of the mounting board 4. The respective ring 12 is suspended from the circular notch 17, as shown in FIGS. 3 and 4. Upon disengagement of the suspension peg 14, the ring 12 is released from its restrained position. The bag 9 attached to the line of the ring 12 then descends to a lower position, which is shown by number 91 in FIG. 1. Further descent of the bag 9 is precluded by engagement of the ring 12 by the reinforcement 13 which surrounds the hole 12. When the bag 9 is in its lower position, a child takes out the present.

The grips 16 may be provided with numbers or symbols e.g. identifying the different days of the Christmas reason, as shown in FIG. 2. These numbers can then be read by a child standing in front of the gift-bearing Santa Claus. The child can pick the appropriate number, pull out the corresponding suspension peg, and a bag which was held in the raised position will descend. As an alternative arrangemnt, it might be the grips which are numbered with the days of the Christmas season, so that again on each corresponding day the child receives a present. Evidently, each bag may contain more than one gift, i.e. one for each child, or there might be more than one bag for each day of the Christmas season.

Figure 6:
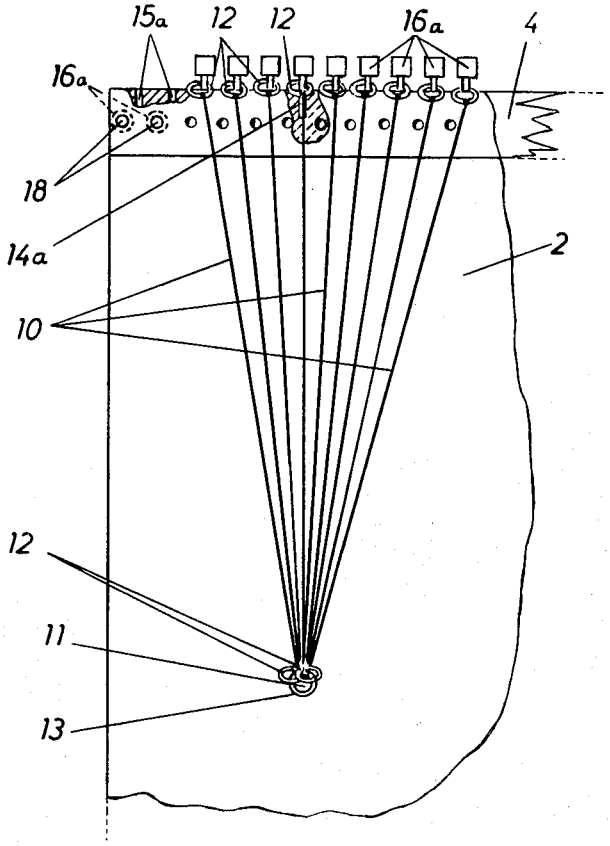
FIG. 6 is a partial rear view showing an alternative embodiment of the present invention having vertically arranged suspension pegs.

In the alternate embodiment shown in FIG. 6, the apertures 15*a* of the mounting strip 4 are vertically directed. Suspension pegs 14*a* are inserted into the apertures 15*a* and are engaged in a correspondingly vertical position at the top of the mounting strip 4. After each suspension peg 14*a* is pulled and the suspended ring 12 falls, the peg is inserted into one of the horizontal apertures 18 so that the number upon the grip is visible to a child standing in front of the gift-bearing Santa Claus figure. Than, he could know, for example, the number of days until Christmas. This embodiment is provided with a number of horizontal apertures 18 which is equal to the number of suspension pegs 14*a*. These horizontal apertures 13 are preferably arranged such that one horizontal aperture 18 is located between two vertical apertures 15*a*.

Figure 7:
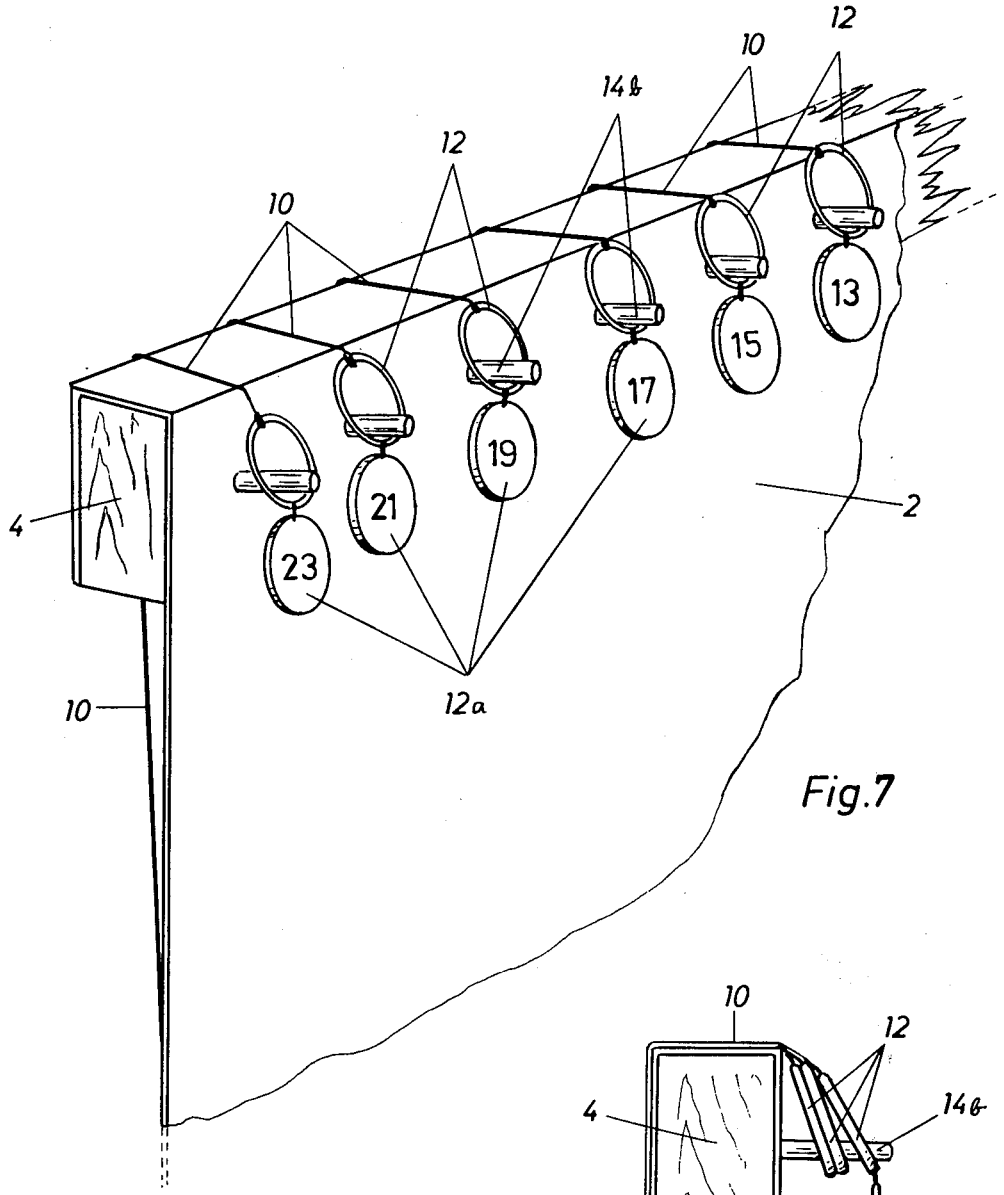
FIG. 7 is a partial top view showing the alternate embodiment of the present invention showing the fastened suspension pegs restraining rings to which a pendant exhibiting a unique number is attached.
Figure 8:
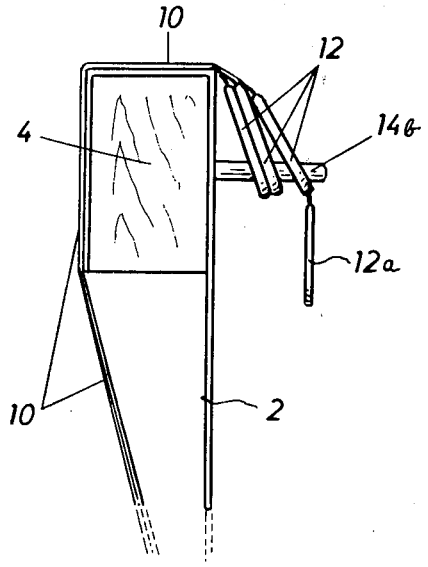
FIG. 8 is a side section top view of a third embodiment of the invention showing each suspension peg restraining a plurality of rings.

In the still simpler embodiment shown in FIGS. 7 and 8, the suspension pegs 14*b* are firmly screwed or driven into the mounting strip 4. The lines 10 are lead from the back of the base over the mounting strip 4 and the attached ring 12 is fitted around a suspension peg 14*b*, such that the rings are located upon the front side of the gift-bearing Santa Claus figure. Each ring 12 is equipped with a numbered pendant 16*a* which serves the same purpose as the grip 16 did in the other embodiments.

The embodiment shown in FIG. 8 shows the suspension of several rings 12 by one suspension peg 14*b* with the arrangement identified by the presence of a pendent 16*a*.

The present invention may be embodied in other specific forms without departing from the spirit or essential characteristics thereof. The presently disclosed embodiments are therefore to be considered in all respects as illustrative and are not restrictive, the scope of the invention being indicated by the appended claims, rather than the foregoing description, and all changes which come within the meaning and range of equivalency of the claims are, therefore, to be embraced therein.

What is claimed as new and desired to be protected by letters Patent is set forth in the appended claims:

1. A gift dispensing device for distributing gifts to children, particularly a replica of a figure which dispenses gifts during the Advent period, comprising:

a. a support upon the front of which a replica of a figure is exhibited with at least one arm;

b. a plurality of containers suspended from each arm;

c. dispensing means disengageable with said support and connected to said containers for lowering said containers.

2. The device of claim 1, wherein said lowering means further comprises a mounting strip with a plurality of apertures; a plurality of suspension pegs, each of which is engaged at one end with one of the apertures; a plurality of rings, each of which is suspended by a suspension peg when said peg is engaged with one of the apertures; and a plurality of thin lines, each of which is connected at one end to one of said rings and at the other end to one of said containers.

3. The device of claim 2, wherein said mounting strip has a plurality of horizontally directed apertures located at the top of said support.

4. The device of claim 3, wherein said support is a quadrilateral.

5. The device of claim 4, further comprising a circular reinforcement surrounding a hole located in each hand of each arm.

6. The device of claim 5, further comprising a grip attached to a free end of each of said suspension pegs.

7. The device of claim 6, wherein said grip is labelled with a number.

8. The device of claim 7, further comprising a circular notch positioned in such a manner around each of said suspension pegs that the part of said pegs with said circular notch protrudes in a horizontal direction through said mounting strip so that one of said rings is securely fitted into said circular notch.

9. The device of claim 8, wherein each of said suspension pegs engage the respective aperture from the front side of said support so that the number on said grip is in front of said support.

10. The device of claim 7, wherein said mounting strip is additionally provided with a plurality of vertically directed apertures so that said suspension pegs are engaged in a correspondingly vertical position at the top of said mounting strip.

11. The device of claim 10, wherein the vertically directed apertures are disposed in an alternate fashion with respect to the horizontally directed apertures.

12. The device of claim 5, further comprising at least one pendant individually attached to one of said rings suspended by one of said pegs which is immovably fixed within an aperture, such that said pendant is located at the front side of said support.

13. The device of claim 1, wherein said containers are bags.

* * * * *